US009079421B2

(12) United States Patent
Kato et al.

(10) Patent No.: US 9,079,421 B2
(45) Date of Patent: Jul. 14, 2015

(54) INKJET PRINTING APPARATUS WITH DOT IMPACT ACCURACY INFORMATION

(75) Inventors: Minako Kato, Kawasaki (JP); Yoshiaki Murayama, Tokyo (JP); Satoshi Azuma, Kawasaki (JP); Yutaka Kano, Yokohama (JP); Minoru Teshigawara, Saitama (JP); Takeshi Murase, Yokohama (JP); Susumu Hirosawa, Tokyo (JP); Kentarou Muro, Tokyo (JP); Shigeyasu Nagoshi, Yokohama (JP); Masao Kato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 261 days.

(21) Appl. No.: 12/964,142

(22) Filed: Dec. 9, 2010

(65) Prior Publication Data

US 2012/0026229 A1 Feb. 2, 2012

(30) Foreign Application Priority Data

Jul. 30, 2010 (JP) ..... 2010-172567

(51) Int. Cl.
*B41J 29/393* (2006.01)
*B41J 2/21* (2006.01)

(52) U.S. Cl.
CPC ..... *B41J 2/2146* (2013.01)

(58) Field of Classification Search
None
See application file for complete search history.

(56) References Cited

U.S. PATENT DOCUMENTS

| | | | | |
|---|---|---|---|---|
| 6,846,066 | B2 | 1/2005 | Teshikawara et al. | |
| 7,410,239 | B2 | 8/2008 | Takahashi et al. | |
| 7,726,763 | B2 * | 6/2010 | Ochiai et al. | 347/15 |
| 7,748,809 | B2 | 7/2010 | Takahashi et al. | |
| 8,205,953 | B2 * | 6/2012 | Azuma et al. | 347/14 |
| 2005/0134617 | A1 * | 6/2005 | Yamaguchi et al. | 347/5 |
| 2006/0214957 | A1 * | 9/2006 | Wada | 347/5 |
| 2006/0274100 | A1 * | 12/2006 | Uji et al. | 347/15 |
| 2007/0165056 | A1 | 7/2007 | Yamaguchi et al. | |
| 2007/0165068 | A1 * | 7/2007 | Tsuboi | 347/41 |
| 2008/0030536 | A1 * | 2/2008 | Furukawa et al. | 347/16 |
| 2008/0252673 | A1 | 10/2008 | Wada et al. | |
| 2008/0273055 | A1 | 11/2008 | Takahashi et al. | |
| 2009/0303272 | A1 * | 12/2009 | Jung | 347/14 |
| 2010/0182367 | A1 * | 7/2010 | Takagi et al. | 347/14 |

FOREIGN PATENT DOCUMENTS

JP 2005-161733 A 6/2005

* cited by examiner

*Primary Examiner* — Geoffrey Mruk
*Assistant Examiner* — Bradley Thies
(74) *Attorney, Agent, or Firm* — Fitzpatrick, Cella, Harper and Scinto

(57) ABSTRACT

To provide an inkjet printing apparatus that suppresses occurrence of image deterioration, such as a texture, a moire, and a streak in a printing result. In order for this to be achieved, a level is set up to a overlapping portion of a chip of a print head depending on dot impact accuracy, and a print data distribution rate of each chip in the overlapping portion is determined according to the level.

4 Claims, 7 Drawing Sheets

| | CHIP A | CHIP B |
|---|---|---|
| LEVEL 1 | 50% | 50% |
| LEVEL 2 | 60% | 40% |
| LEVEL 3 | 70% | 30% |
| LEVEL 4 | 80% | 20% |
| LEVEL 5 | 90% | 10% |
| LEVEL 6 | 100% | 0% |

INKJET PRINTING APPARATUS WITH DOT IMPACT ACCURACY INFORMATION

BACKGROUND OF THE INVENTION

1. Field of the Invention

The present invention relates to an inkjet printing apparatus that adopted the inkjet system.

2. Description of the Related Art

Conventionally, for the inkjet printing apparatus, a printing apparatus in which ink ejection ports are arranged over the whole length equivalent to a width of a printing medium, namely the printing apparatus of a full line type, is proposed. When manufacturing a long-length ink ejection head that is used in the printing apparatus of a full line type, constructing it by arranging a large number of nozzles on a single board with a high density is accompanied by many difficulties in terms of technology and costs. Therefore, it is proposed to realize the long-length ink ejection head by arranging a plurality of short-length ink ejection units (hereinafter referred to as a "chips") that are relatively cheap and easy to manufacture. There is proposed a head in which the chips each having a plurality of ink ejection ports (hereinafter, also referred to as "nozzles") are placed staggeredly so as to overlap each other in a direction perpendicular to the nozzle row 11.

Below, the head in which the short-length chips are arranged so as to overlap each other is called a "overlapping head", an overlap area is called a "overlapping portion", and an area where the chips do not overlap is called a "non-overlapping portion". Since the overlapping portion forms an image with a plurality of chips, the image is formed with a large number of ejection port rows compared with the non-overlapping portion. Therefore, a method of selectively using the ejection ports in the overlapping portion has been disclosed.

Japanese Patent Laid-Open No. 2005-161733 discloses a method: first it is judged whether an end part of an image to be printed is included in the overlapping portion of the chips that overlap each other; and if it is included, overlapped nozzles corresponding to the overlapping portion of the chips and nozzles other than the overlapped nozzles that communicate that overlapped nozzles are used as a group of nozzles to be used.

Incidentally, a case where the printing is performed by the overlapping portion brings a following merit. Generally, when the image is formed using a plurality of chips of the overlapping portion, it exerts an effect of reliving deviations of an ejection direction and the amount of ejection that each nozzle has, so-called an effect of multi-pass printing, and the image is improved. In addition, conversely, the overlapping portion also comes with a disadvantageous point: an image may deteriorate because of impact displacement between the both chips forming the overlapping portion.

Generation of such impact displacement will result in occurrence of image deterioration, such as a texture, a moire, and a streak. In terms of this point, it can be said that printing with a single chip is advantageous. That is, in the overlapping portion, a merit that the both chips overlapping each other are used exists and a merit that a single chip is used exists, respectively, and they are in a tradeoff relationship. A factor is the dot impact accuracy between the chips, and the dot impact accuracy of a chip alone.

The above-mentioned conventional technology discloses that the overlapping portion is formed with a single chip. This is only paying attention to one of the problems: it does not refer to the problems that become a tradeoff as described above and does not solve it.

SUMMARY OF THE INVENTION

Then, the present invention has an object to provide an inkjet printing apparatus that suppresses occurrence of image deterioration, such as a texture, a moire, and a streak in a printing result.

The inkjet printing apparatus according to the present invention is an inkjet printing apparatus that has a printing unit equipped with, in a overlapping portion in an arrangement of a plurality of chips on which nozzles are arranged, the chips arranged so that nozzles of end parts of the chips may overlap to one another in a direction intersecting an arrangement direction of the nozzles and a control unit that selectively distributes the print data corresponding to the overlapping portion to the nozzles of the overlapping portion and makes the nozzles eject ink droplets (dots) onto the printing medium from the nozzles, wherein the control unit is equipped with acquisition unit for acquiring the impact accuracy of the ink droplet that impacts onto the printing medium from the overlapping portion and determination unit configured to determine the distribution rate of the print data to each chip of the overlapping portion based on the dot impact accuracy.

According to the present invention, the control unit of the inkjet printing apparatus is equipped with determination unit configured to determine the impact accuracy of the ink droplet impacting onto the printing medium and the determination unit configured to determine the distribution rate of the print data for each chip of the overlapping portion. By this, the inkjet printing apparatus that suppresses occurrence of the image deterioration, such as a texture, a moire, and a streak, in the printing result.

Further features of the present invention will become apparent from the following description of exemplary embodiments (with reference to the attached drawings).

DESCRIPTION OF THE EMBODIMENTS (First Embodiment)

Figure 1:
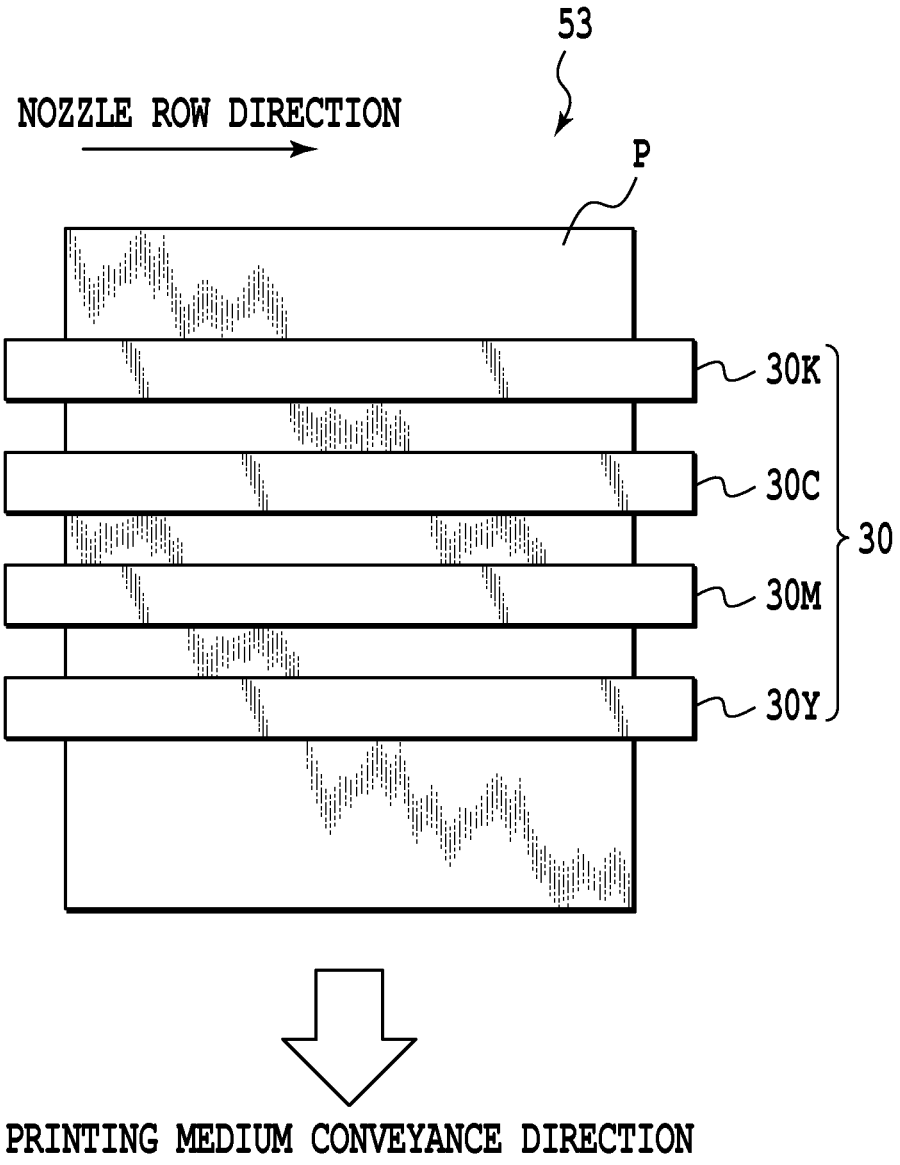
FIG. 1 is a diagram showing an outline configuration of a printing unit of a printing apparatus according to the present invention.

Hereafter, a first embodiment of the present invention will be explained with reference to drawings. FIG. 1 is a diagram showing an outline configuration of a printing unit of a printing apparatus according to the present invention. In the printing apparatus of this embodiment, print heads 30K, 30C, 30M, and 30Y are aligned mutually in parallel, and the print heads are connected with respective storage tanks of a black (K) ink, a cyan (C) ink, a magenta (M) ink, and a yellow (Y) ink (unillustrated). The printing apparatus performs printing by giving the inks of these colors to the printing medium P from these respective print heads 30K, 30C, 30M, and 30Y. The print heads 30K, 30C, 30M, and 30Y are ones that have substantially the same configuration, and in explanation below, these are collectively described by a print head 30 unless there is a need of discriminating them especially. The printing medium P is conveyed in a direction perpendicular to a nozzle row direction of the print head. By making the print head 30 longer than a width of the printing medium P, printing on the whole surface of the printing medium becomes possible.

Figure 2:
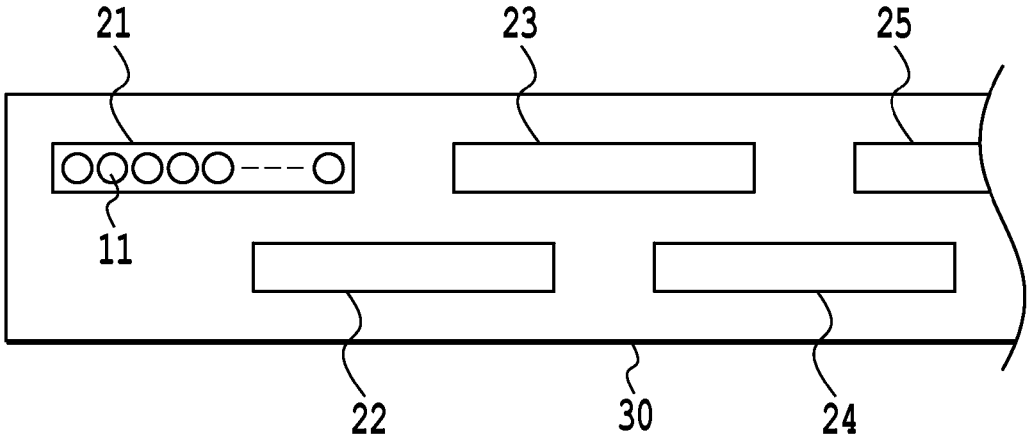
FIG. 2 is a diagram explaining a configuration of a print head according to the present invention.

FIG. 2 is a diagram explaining a configuration of the print head 30 according to the present invention. The chips 21, 22, 23, 24, and 25 each have a nozzle row 11 consisting of a plurality of nozzles each for ejecting an ink. The chip 21 and the chip 22 are placed substantially in parallel to each other in the nozzle row direction and with a gap in a direction intersecting the nozzle row direction. The chip 21 and the chip 22 are placed with parts of the nozzle rows at end parts of the chips overlapped each other, and a portion where the two chips overlap forms a overlapping portion. Similarly, a pair of the chip 22 and the chip 23, a pair of the chip 23 and the chip 24, a pair of the chip 24 and the chip 25 are placed with parts of the nozzle rows overlapped alternately like a relationship of the chip 21 and the chip 22, so that a long-length print head 30 is formed with the chips 21 through the chip 25 placed staggeredly. The printing apparatus is appropriately configured so that the length of the print head, the number of the chips, the width of the overlapping portion, the number of the nozzle rows, the number of the nozzles, etc. may suit a use.

Incidentally, a displacement of the impact position of the print dot exerts a large effect on image formation in the printing apparatus equipped with a plurality of ink ejection units. The displacement of the dot impact position takes place in the case where position accuracy of the ink ejection unit at the time of manufacture is not sufficient, or due to a deviation of an ejection speed of an ink droplet, further due to a displacement of conveyance of the printing medium P, etc. Conventionally, an operation of adjusting impact positions as much as possible to suppress their discrepancies is performed by an operation of intentionally shifting ejection timings or shifting the nozzles to be used. This operation is called "registration adjustment". For this registration adjustment, a method whereby a predetermined pattern is drawn by both ink ejection units that are intended to be adjusted and the pattern is examined by visual inspection or by an output of a sensor etc. is common.

Figure 3A:
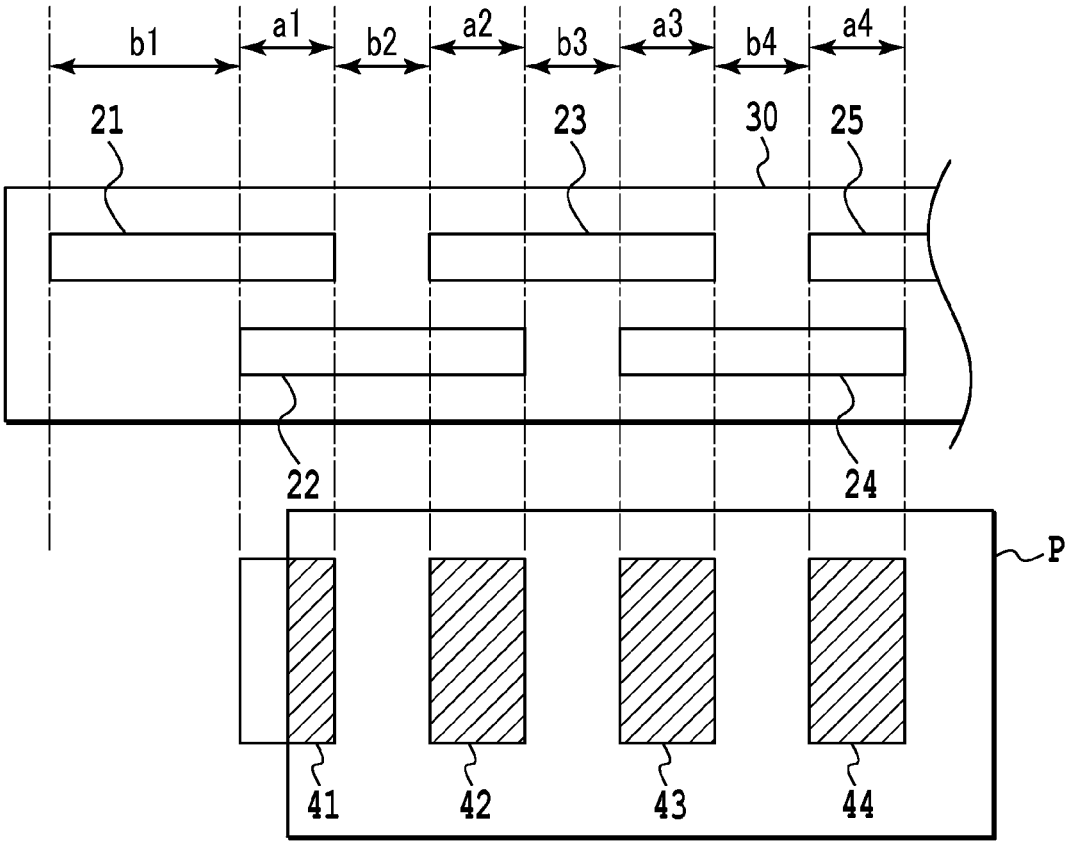
FIG. 3A is a diagram explaining a positional relationship between a plurality of chips constituting the print head and the printing medium at the time of registration adjustment.

FIG. 3A is a diagram explaining a spatial relationship between a plurality of chips constituting the print head 30 and the printing medium P at the time of the registration adjustment. The explanation will be given using the same reference numerals of the chip and the print head as those of FIG. 2. The following symbols are used: the overlapping portion of the chip 21 and the chip 22 is an area a1; the overlapping portion of the chip 22 and the chip 23 is an area a2; the overlapping portion of the chip 23 and the chip 24 is an area a3; and the overlapping portion of the chip 24 and the chip 25 is an area a4. Non-overlapping portion of the chips 21, 22, 23, and 24 are designated by areas b1, b2, b3, and b4, respectively.

Here, an operation at the time of the registration adjustment will be explained. As shown in FIG. 3A, patterns for registration adjustment among chips 41, 42, 43, and 44 are drawn on the printing medium P. Contrary to a fact that the patterns 42, 43, and 44 can be drawn fully without missing a part thereof, the pattern 41 cannot be completed as a whole thereof because the printing medium P is short in width.

Therefore, precise registration adjustment between the chip 21 and the chip 22 is difficult to perform irrespective of detection methods, such as detecting a registration adjustment pattern by visual inspection or reading with a sensor. The registration adjustment values between the chip 22 and the chip 23, between the chip 23 and the chip 24, and between the chip 24 and the chip 25 are computed, and is set up and reflected at the time of printing. On the contrary, an optimal registration adjustment value between chips of the chip 21 and the chip 22 is not computed, and cannot be reflected at the time of the printing either. That is, the area a1 is an area where the registration adjustment between chips was not able to be performed, and areas a2 to a4 are areas where the registration adjustments between chips were able to be performed.

Figure 3B:
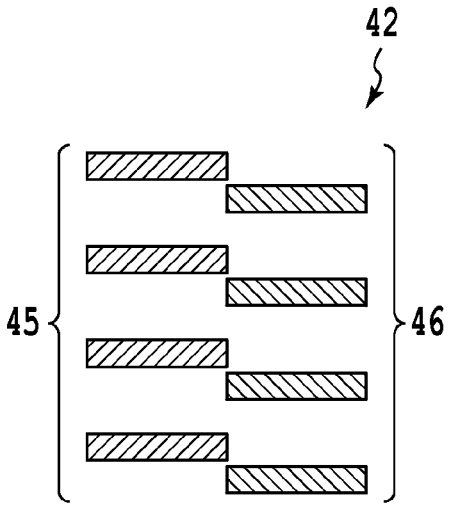
FIG. 3B is a diagram showing one example of a registration adjustment pattern.

Moreover, FIG. 3B is a diagram showing one example of the registration adjustment pattern: it shows a registration adjustment pattern 42 between chips of the chip 22 and the chip 23. A pattern 45 where a plurality of lines are arranged is drawn with the chip 22, and a pattern 46 where a plurality of lines are similarly arranged is drawn with the chip 23. In such patterns, the amount of displacement of the pattern 45 and the pattern 46 becomes the amount of registration displacement between the chips. If the registration is adjusted optimally, there will be no displacement in both patterns and they will be drawn at substantially the same position.

Figure 4:
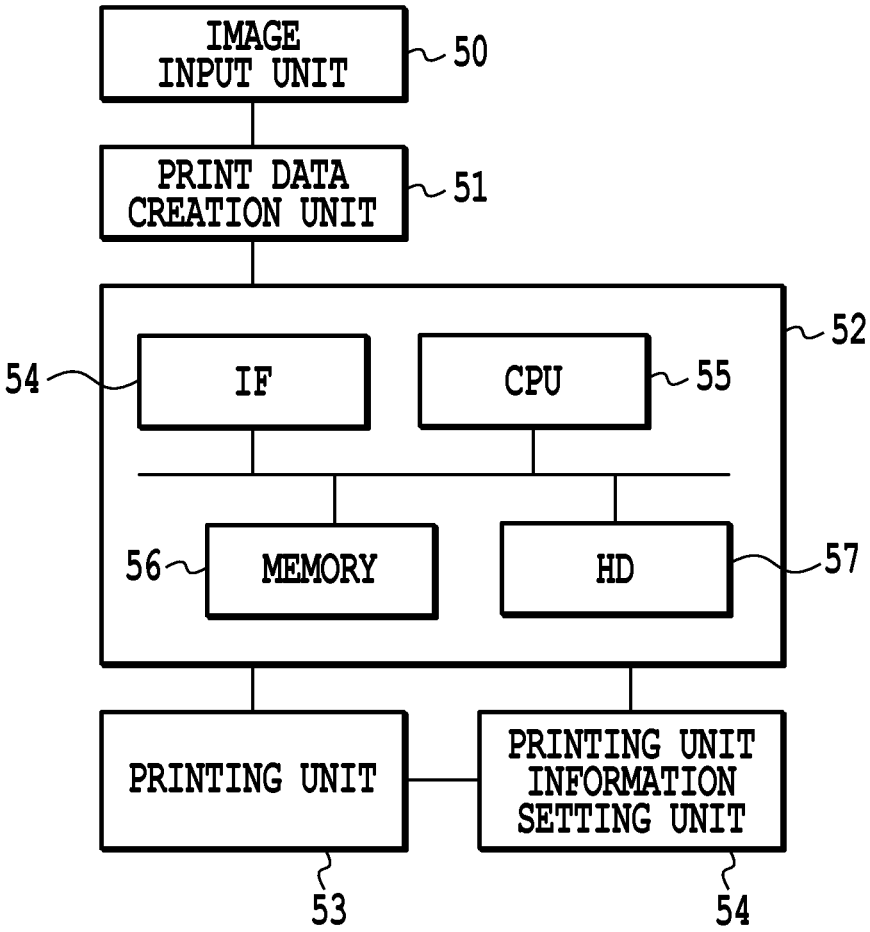
FIG. 4 is a block diagram showing a printing system of the printing apparatus of this embodiment.

FIG. 4 is a block diagram showing a printing system of the printing apparatus of this embodiment. This system is constructed having roughly an image input unit 50, a print data generation unit 51, an ejection data control unit 52, a printing unit 53, and a printing unit information setting unit 54. The image input unit 50 receives an image to be printed from the outside of the printing system, performs a predetermined image processing, and passes it to the print data generation unit 51. The print data generation unit 51 performs various image processings, and performs data conversion of it into a form that the printing unit 53 can print. The ejection data control unit 52 receives the print data from the print data generation unit 51, and associates it with the print head. The printing unit 53 receives ejection data and performs printing by ejecting the inks. The printing unit information setting unit 54 acquires state information of this printing apparatus, and passes it to the ejection data control unit 52. The state information of the printing apparatus is any one of information showing a state of the printing apparatus, such as registration adjustment information showing dot impact accuracy of the chips, i.e., a read result of the above-mentioned registration adjustment pattern etc., unejecting nozzle information, paper conveyance accuracy information, information of dot impact accuracy and the amount of ejection of each chip alone, etc. The ejection data control unit 52 is equipped with an interface (IF) 54, a central processing unit (CPU) 55, memory 56, and a hard disk drive (HD) 57, etc. The CPU 55 performs a signal processing in accordance with software for performing various kinds of signal processings stored in the memory 56 and the HD 57.

The print data generation unit 51 converts the image data into bit map data that the printing apparatus can print using the conventionally known method. First, it receives the image data to be printed from the image input unit. It performs an image size decision processing of deciding an image size depending on dimensions of the printing medium and a print mode on this image data. Furthermore, the image data is subjected to a color conversion processing of performing color conversion depending on the type of the printing medium and the print mode so that optimal colors may be reproduced in the printing apparatus.

In the processing, the image data becomes RGB data with multiple values for respective colors. Next, an ink data decomposition processing that converts the RGB image data into CMYK data that the printing apparatus uses is performed. Furthermore, a quantization processing of the CMYK data and a dot pattern development processing of developing the quantized image data into a dot pattern are performed. Through the above-mentioned processings, the image to be printed is converted into a bit map image such that each pixel of each color of CMYK is represented by ON or OFF of the dot.

Figure 5:
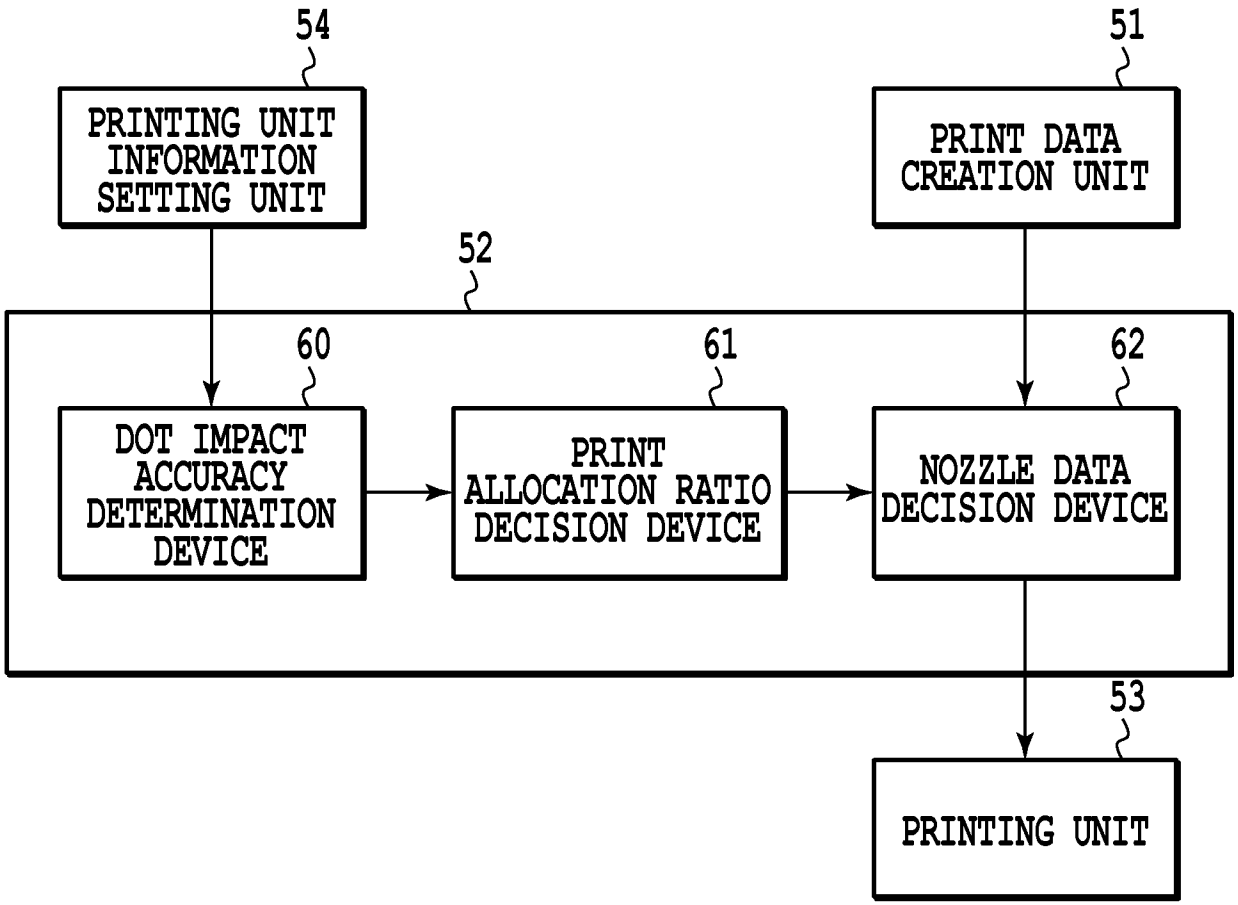
FIG. 5 is a block diagram showing a configuration of an ejection data control unit.

FIG. 5 is a block diagram showing a configuration of the ejection data control unit 52. The ejection data control unit 52 is constructed having dot impact accuracy determination unit 60, print data distribution rate determination unit 61, and nozzle data determination unit 62.

Figures 6A, 6B:
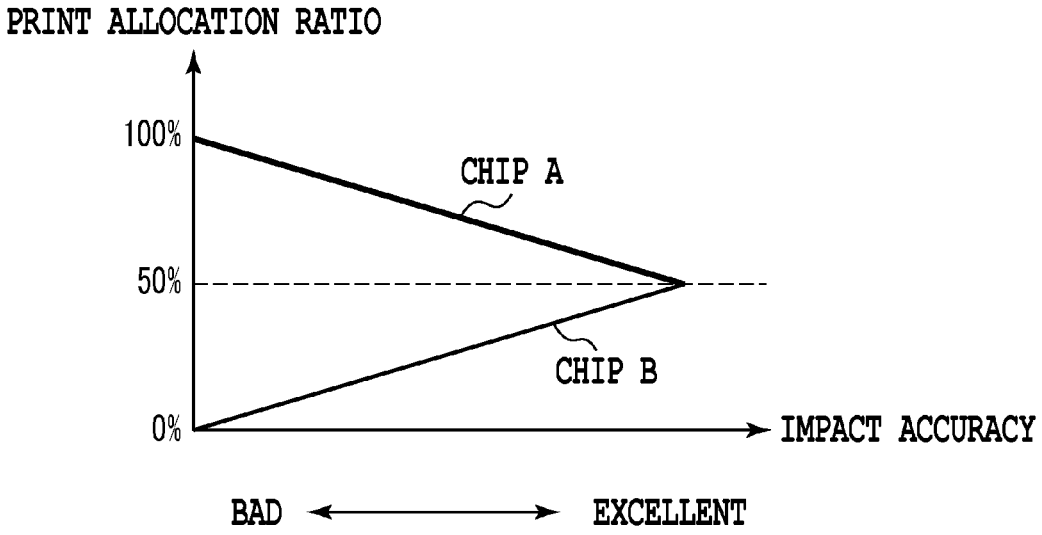
FIG. 6A is a diagram showing a relationship between distribution rates of the print data of chips A and B and a dot impact accuracy in a overlapping portion.
FIG. 6B is a diagram showing a relationship between the distribution rates of the print data of the chips A and B and the dot impact accuracy in the overlapping portion.

Hereafter, a characteristic configuration of this embodiment will be explained. Designating two chips that constitute the overlapping portion by a chip A and a chip B, a relationship of the distribution rates of the print data of the chips A and B and the dot impact accuracies of the two chips in the overlapping portion is as shown in FIG. 6A. In FIG. 6A, the horizontal axis represents dot impact accuracies of the chips and the vertical axis represents a print data distribution rate. When the dot impact accuracies of the chips are bad, if the printing is performed equally with the chips of the both sides constituting the overlapping portion, a texture, a moire, etc. will occur. Therefore, performing the printing only with whichever chip with a better impact accuracy will render an excellent image.

Therefore, when dot impact accuracies of the chips are bad, the print data distribution rate is set to 100% in one chip and 0% in the other chip. On the other hand, when the dot impact accuracies of the chips are excellent, performing the printing using both chips of the both sides that constitute the overlapping portion will result in obtaining an excellent image because of an effect of the multi-pass printing. Therefore, when the dot impact accuracies of the chips are excellent, the printing is performed using the both chips. In this embodiment, the print data distribution rate shall be 50% for each chip. Incidentally, the print data distribution rate is not limited to be 50% for each, and can take values from 100:0 to 50:50 depending on dot impact accuracy information of the chips, as shown in FIG. 6A. Thus, in this embodiment, the distribution rate of the print data in the overlapping portion is changed depending on the impact accuracy information of the chips.

FIG. 6B shows a table showing a relationship of FIG. 6A. The dot impact accuracies of the chips are divided into six steps of levels, and the distribution rates of the print data corresponding to the chip A and the chip B are set for each level. Level 1 is a level in which the impact accuracy is the best and the print data distribution rate becomes 50:50. Level 6 is a level in which the impact accuracy is the worst and the print data distribution rate is set to 100:0. The dot impact accuracy determination unit 60 receives the registration adjustment information from the printing unit information setting unit 54, determines the dot impact accuracy according to it, and decides the levels 1 to 6.

The print data distribution rate determination unit 61 refers to FIG. 6B from a determined level and determines the print data distribution rate to each of the chips that constitute the overlapping portion. The nozzle data determination unit 62 performs a thinning processing on bitmapped image data passed from the print data generation unit 51 at the determined print data distribution rate, and passes it to the printing unit 53. It is recommendable to use the conventionally known mask processing etc. for the thinning processing.

The processing will be explained specifically below.

The area a2 is the overlapping portion of the chips 22 and 23, and the registration adjustment can be performed as described above. The dot impact accuracy determination unit 60 receives the dot impact accuracy information of these two chips. In this embodiment, the dot impact accuracy information includes information as to whether the registration adjustment has been done, and for this area a2, it is considered that the registration adjustment has been done. Based on this impact accuracy, the dot impact accuracy determination unit 60 assumes that the registration adjustment between the chips has been done and the dot impact accuracy is excellent, and determines the area a2 to be in "Level 1". In that case, the print data distribution rate determination unit 61 sets the printing distribution rate to "Level 1", that is, the chip A is 50% and the chip B is 50%. Receiving the determined print data distribution rate, the nozzle data determination unit sets a printing ratio of 50% to both the chip 22 and the chip 23. This setting shows that when printing the overlapping portion a2, pieces of the print data distributed to the chip 22 and the chip 23 are substantially equal.

The area a1 is a case where the width of the printing medium P is insufficient and the pattern is not completed by the printing. The dot impact accuracy determination unit 60 receives the impact accuracy. This impact accuracy includes information that the registration adjustment has not been done. Based on this information, the dot impact accuracy determination unit 60 judges that the dot impact accuracies of the chips are bad, and determines the area a1 to be in "Level 6". The print data distribution rate determination unit decides the print data distribution rate to be 100% to 0% from FIG. 6B upon reception of the determination of Level 6. The nozzle data determination unit decides the distribution rate to the chip 21 to be 0% and the distribution rate to the chip 22 to be 100%, upon reception of the decided print data distribution rates.

That is, this shows that when printing the overlapping portion a1, only the chip 22 is used. In this embodiment, since the chip 22 is subjected to the registration adjustment between the chip 23 and itself in the area a2, it can be said that the impact accuracy between the chip 23 and itself is excellent. Therefore, considering that the registration adjustment has not been performed between the chip 21 and the chip 22 and that printing in the area b2 is performed only with the chip 22, the distribution rate to the chip 22 is set to 100% and the distribution rate to the chip 21 is set to 0%.

Incidentally, the control method is not limited to the method explained above. In the explanation described above, if the registration adjustment has been completed in the impact accuracy information, the current level is set to Level 1; and if it has not been completed, the current level is set to Level 6. The present invention is not limited to this, and the level determination may be down further more finely depending on the degree of the registration adjustment. At his time, the impact accuracy information includes not only the above-mentioned registration adjustment information, but also dot impact accuracy information that is the impact accuracy information of each chip alone. Although the registration adjustment is performed, as described above, by an operation of shifting an ejection timing and a nozzle in use, they cannot be ideally adjusted always. For example, in the case where the registration adjustment is performed by shifting the nozzle, the finest accuracy is governed by a nozzle pitch. Therefore, the error will occur by a degree up to about one-half of the nozzle pitch. Similarly, also in the case where the registration adjustment is performed by shifting the ejection nozzle, there is a limit with respect to a finesse of the amount of shifting, and consequently an error as much as about its one-half will occur. Because of above descriptions, the level determination is performed considering the error at the time of the registration adjustment. If there is almost no error, the current level is set to "Level 1"; if the registration adjustment has not been performed, the current level is set to "Level 6"; if the level adjustment has been performed but the error is the maximum, the current level is set to "Level 5"; and if being in other cases, the current level is subjected to level division according to the amount of the error. This is determined for each connection area at the time of the registration adjustment work of the chips, and is stored as printing apparatus information. One example is shown below. Assume that an error in the registration adjustment of the chips in a overlapping portion of the area a3 is large and is equivalent to "Level 5". The dot impact accuracy determination unit 60 receives information corresponding to "Level 5". In this case, the print data distribution rate determination unit decides the current level is "Level 5", namely deciding the distribution rates of 90% and 10% for the respective chips. It is recommendable to determine to which chip more print data shall be distributed, the chip 23 or the chip 29, from the dot impact accuracy information of each chip alone. For example, in the case where the impact accuracy of the chip 23 is excellent and the impact accuracy of the chip 24 is bad, the print data distribution rate of the chip 23 becomes 90% and the print data distribution rate of the chip 24 becomes 10%. Regarding the dot impact accuracy information of each chip alone, it fluctuates by a deviation of the ejection direction and the ejection speed that the individual nozzle has, and therefore it is recommendable to measure and print it separately. The accuracy information of the chip alone can be acquired by conventionally known methods, such as a method whereby a pattern is printed and a distance between dots thereof is measured and a method of measuring the ejection speed of the ink. The print data distribution rate shown in FIG. 6A and FIG. 6B is one example, and can be arbitrarily designed to match the printing apparatus. Similarly, the threshold of level division can be arbitrarily designed to match the printing apparatus. Moreover, the method of allocating it to the two chips is not limited to the method of the print data distribution rate with the above-mentioned mask. The method may be any arbitrary method: a method of not inputting energy to a nozzle not in use; a method of adding white data to the image; etc. Moreover, although this embodiment was explained with the system that uses the inks of four colors, the colors of inks are not limited to this. An ink of a like but thinner color may be used for higher definition, and a spot color, such as red, green, etc. may be used.

In this way, the level is set up to the overlapping portion of the chips of the print head depending on the impact accuracy information, and the print data distribution rate of the each chip in the overlapping portion is decided according to the level. By this, the inkjet printing apparatus that suppresses occurrence of image deterioration, such as a texture, a moire, and a streak, in a printing result succeeded in being actually implemented.

(Second Embodiment)

Hereafter, a second embodiment of the present invention will be explained with reference to drawings. Incidentally, since a fundamental configuration of this embodiment is the same as that of the first embodiment, only characteristic points of the configuration will be explained. In the first embodiment, the level determination was performed based on the registration adjustment information and the dot impact accuracy information as information of the accuracy. However, it is not only the registration adjustment and the impact accuracy of a chip alone that govern the dot impact accuracy. The dot impact accuracy varies also with mechanical accuracy, such as paper conveyance accuracy. Incidentally, this embodiment uses the printing apparatus, the print head, and the printing system that were explained in the first embodiment. In the explanation below, the same reference numeral as the reference numerals explained in the first embodiment are used.

The printing medium P is usually pressed down and conveyed by a plurality of printing medium conveying rollers. When doing this, there is a case where a displacement of the impact position of the print dot occurs in the conveyance direction of the printing medium P. Moreover, there is a case where the amount of displacement of the impact position fluctuates in the nozzle row direction (a direction intersecting the conveyance direction of the printing medium P). This is because flexure, bending, etc. occur in the printing medium depending on how to press down the printing medium, or a fluctuation occurs in the amount of conveyance due to a fluctuation of a diameter of the printing medium conveying roller. If flexure, bending, etc. occur in the printing medium P, a distance between the ink ejection port plane of the print head and the printing medium P will fluctuate. If the distance between the ink ejection port plane and the printing medium plane fluctuates, a time needed for the ink dot ejected from the ink ejection port to arrive at the printing medium plane will fluctuate, and consequently there will occur a phenomenon that an actual dot impact position will displace from the dot impact position assumed in advance. Similarly, if the amount of conveyance of the printing medium fluctuates, a dot will impact onto a position displaced from an expected impact position.

In order to cope with such a phenomenon, in this embodiment, the print area of the printing medium P is divided into several areas in a direction intersecting the printing medium conveyance direction and the level of the dot impact accuracy is set up for each area. Then, the printing distribution rate for each area is decided according to that level setting.

Figure 7:
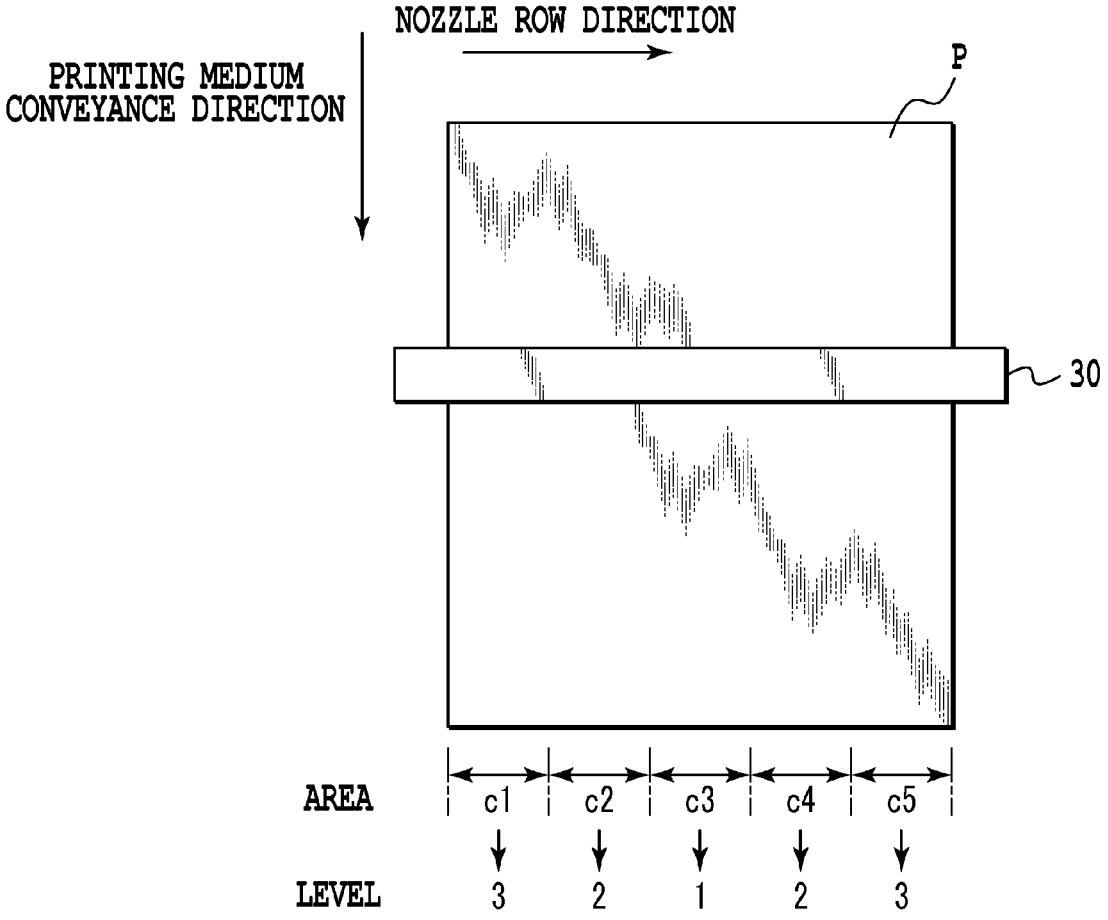
FIG. 7 is a diagram showing each area that was divided out of the printing medium.

FIG. 7 is a diagram showing each area that was divided out of the printing medium P. To the print head 30, the printing medium P is divided into areas C1, C2, C3, C4, and C5 in a nozzle arrangement direction and a printing medium conveyance accuracy at each position is detected. For the detection, conventionally known methods, such as a method whereby a known pattern is printed on the printing medium and each impact accuracy is measured, a method of measuring a diameter of a printing medium conveyance roller, and a method of measuring a speed of the printing medium using a speed sensor, are used. In this embodiment, this printing medium conveyance accuracy is passed to the dot impact accuracy determination unit 60 as the impact accuracy information. The dot impact accuracy determination unit 60 determines a dot impact position accuracy level from the printing medium conveyance accuracy for respective areas C1 to C5.

As a result of the determination, the areas C1 and C5 is in Level 3, the areas C2 and C4 is in Level 2, and the area C3 is in Level 1. Then, the print data distribution rate determination unit 61 decides the print data distribution rates for the chips that constitute the overlapping portion corresponding to each area upon reception of these level determinations. The print data distribution rates are set up as follows, respectively: 70%:30% for the overlapping portion located in the areas C1 and C5; 60%:40% for the overlapping portion located in the areas C2 and C4; and 50%:50% for the joint area located in the area C3. The nozzle data determination unit 62 decides so that the image data may be distributed to the respective overlapping portions according to the print data distribution rate being set up.

Incidentally, although the example where the dot impact accuracy is excellent in the central part of the printing medium and the dot impact accuracy becomes worse as the dot goes nearer to the ends symmetrically was shown, but it is natural that the case is not limited to this. It is natural that a tendency of the impact accuracy varies depending on an actual apparatus. Moreover, a way of how to divide the printing medium into areas and a way of how to detect the printing medium conveyance accuracy are not limited to the above-mentioned methods.

Incidentally, since when the width of the printing medium changes, a use position of the printing medium conveying roller etc. changes, the printing medium conveyance accuracy often varies. It is recommendable to change thresholds that serve as criteria of area division and level determination depending on the width of the printing medium. Furthermore, the printing medium conveyance accuracy and the threshold of level determination may be changed depending on the color of the ink, the type of the printing medium, the width of the printing medium, a printing mode, etc. It is effective that they are changed between in the case of a color in which the displacement is conspicuous and in the case of a color in which the displacement is inconspicuous. In either way, they must only be decided suitably depending on the configuration and the accuracy of the printing apparatus, the printing medium, and the print head.

In this way, the level is set up depending on the impact accuracy information for the overlapping portion of the chips of the print head, and the print data distribution rate of each chip in the overlapping portion is decided according to that level. Thereby, the inkjet printing apparatus that suppresses occurrence of image deterioration on the printing result, such as a texture, a moire, and a streak succeeded in being actually implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-172567, filed Jul. 30, 2010, which is hereby incorporated by reference herein in its entirety.

What is claimed is:

1. An inkjet printing apparatus having a printing unit provided with a first nozzle array and a second nozzle array in which nozzles are arranged, the first nozzle array and the second nozzle array are arranged along a direction intersecting an arrangement direction of the nozzles so that nozzles in an end part of the first nozzle array and nozzles in an end part of the second nozzle array form an overlapping portion, the apparatus comprising:

an acquisition unit configured to acquire information which indicates whether a registration adjustment between the first nozzle array and the second nozzle array which form the overlapping portion was performed;

a determination unit configured to determine a distribution rate of print data corresponding to the overlapping portion for each of the first nozzle array and the second nozzle array based on the information; and a distribution unit configured to distribute the print data corresponding to the overlapping portion to the nozzles of the overlapping portion, respectively, based on the determined distribution rate, wherein the determination unit, if the information indicates that the registration adjustment has been performed, determines the distribution rate so that the print data may be distributed to both end parts of the first and second nozzle arrays, and if the information indicates that the registration adjustment has not been performed, determines the distribution rate so that the print data may be distributed to one of the end parts of the first and second nozzle arrays.

2. The inkjet printing apparatus according to claim 1, wherein the determination unit determines the distribution rate of the print data in accordance with at least one of a color of an ink used for printing, a type of print medium, a width of a print medium, and a print mode, in addition to the information.

3. The inkjet printing apparatus according to claim 1, wherein the information corresponds to a result of having measured a pattern for registration adjustment printed on a print medium or a result inputted by the user.

4. A method of controlling an inkjet printing apparatus that includes a printing unit provided with a first nozzle array and a second nozzle array in which nozzles are arranged, the first nozzle array and the second nozzle array are arranged along a direction intersecting an arrangement direction of the nozzles so that nozzles in an end part of the first nozzle array and nozzles in an end part of the second nozzle array form an overlapping portion, the method comprising:

an acquisition step of acquiring information which indicates whether a registration adjustment between the first nozzle array and the second nozzle array which form the overlapping portion was performed;

a determination step of determining a distribution rate of print data corresponding to the overlapping portion for each of the first nozzle array and the second nozzle array based on the information; and a distribution step of distributing the print data corresponding to the overlapping portion to the nozzles of the overlapping portion, respectively, based on the determined distribution rate, wherein if the information indicates that the registration adjustment has been performed, the distribution rate is determined, in the determination step, so that the print data may be distributed to both end parts of the first and second nozzle arrays, and if the information indicates that the registration adjustment has not been performed, the distribution rate is determined, in the determination step, so that the print data may be distributed to one of the end parts of the first and second nozzle arrays.

* * * * *